US007861383B2

(12) United States Patent
Yamamoto

(10) Patent No.: US 7,861,383 B2
(45) Date of Patent: Jan. 4, 2011

(54) CLASP, ACCESSORY BRACELET, AND TIMEPIECE

(75) Inventor: Akio Yamamoto, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 748 days.

(21) Appl. No.: 11/798,412

(22) Filed: May 14, 2007

(65) Prior Publication Data

US 2007/0271747 A1 Nov. 29, 2007

(30) Foreign Application Priority Data

May 26, 2006 (JP) ..... 2006-146158

(51) Int. Cl.
*A44B 21/00* (2006.01)
*A44B 11/00* (2006.01)

(52) U.S. Cl. ..... 24/71 J; 24/71 ST; 24/265 WS; 368/282

(58) Field of Classification Search ..... None
See application file for complete search history.

(56) References Cited

U.S. PATENT DOCUMENTS 1,997,723 A 4/1935 Franklin
2,588,655 A 3/1952 O'Neill
3,404,440 A 10/1968 Weiss
3,696,469 A 10/1972 Kalinsky
5,771,543 A 6/1998 Froidevaux et al.

FOREIGN PATENT DOCUMENTS

CH 628787 3/1982
CH 667979 A5 11/1998
JP 2003-199605 A 7/2003
JP 2005-270248 A 10/2005

*Primary Examiner*—Jack W. Lavinder
(74) *Attorney, Agent, or Firm*—Global IP Counselors, LLP

(57) ABSTRACT

A clasp for connecting a pair of bands has a support member connected to one of the bands and a movable member connected to the other of the bands. A plurality of engaging parts that engage the movable member are disposed to the support member along the length of the band, and the movable member can be moved from one engaging part to another engaging part only when the movable member is inclined to the support member. The length can therefore be adjusted with a simple, easily understood operation using a simple and compact arrangement.

9 Claims, 11 Drawing Sheets

CLASP, ACCESSORY BRACELET, AND TIMEPIECE

BACKGROUND

1. Field of Invention

The present invention relates to a clasp, to an accessory bracelet having the clasp, and to a timepiece.

2. Description of Related Art

Various kinds of clasps are used on bracelets and accessory bands such as wristwatch bands. Folding clasps, such as double folding clasps, triple folding clasps, and double deployment or butterfly clasps, are commonly used on wristwatches. Japanese Unexamined Patent Appl. Pub. JP-A-2005-270248, for example, teaches a folding clasp having a movable member that is connected to the band and is supported freely movably by the clasp cover, and has engaged inside this movable member a push button for locking and releasing the clasp in such a way that the clasp can be released and the length of the band can be slightly adjusted by operating this push button.

A problem with this related art is that it is difficult to differentiate between the two operating positions, one for releasing the clasp and the other for adjusting the length, when operating the push button. One method of solving this problem is to provide separate operators for releasing the clasp and adjusting the bracelet length, but it is extremely difficult to render such operators without increasing the size of the mechanism.

SUMMARY

A clasp according to the present invention enables adjusting the length with a simple, easy-to-understand operation by means of a simple and compact arrangement, and a bracelet type accessory and timepiece according to the invention use this clasp.

A first aspect of the invention is a clasp for connecting a pair of bands, the clasp having a support member connected to one of the bands; and a movable member connected to the other of the bands. A plurality of engaging parts that engage the movable member are disposed to the support member along the length of the band; and the movable member can be moved from one engaging part to another engaging part only when the movable member is inclined to the support member.

The interval between the pair of bands connected to each other through the intervening clasp can thus only be changed by inclining the movable member of the clasp to the support member and then moving the movable member from one engaging part to another engaging part. The length of the band can therefore be adjusted by means of a simple and easy-to-understand operation. The size of the clasp can also be easily reduced because the clasp is constructed from a very simple arrangement using a support member and a movable member.

Preferably, a catch part is formed on the distal end part of the movable member, and the catch part is shaped so that the size of the catch part in line with the length of the band decreases In addition, at least one of the engaging parts is rendered as a protrusion into the space where the catch part is held, and forms on the distal end side thereof a passage enabling the catch part to pass only when in the position where the size is decreased.

When thus arranged the size of the catch part aligned with the thickness of the band becomes smaller when the movable member is inclined so that the catch part can pass over the distal end of the engaging part of the support member. An arrangement enabling changing the engaging part that holds the movable member only when the movable member is inclined can thus be achieved by means of a very simple, compact construction.

In another aspect of the invention a catch part is formed on the distal end part of the movable member for engaging an engaging part of the support member; at least one of the engaging parts is rendered as a protrusion into the space where the catch part is held, forming on the distal end side thereof a passage of a size enabling the catch part to pass; and the catch part moves to the passage side and can pass through the passage only when the movable member is inclined to the support member.

The catch part thus moves when the movable member is inclined so that the catch part can pass over the distal end of the engaging part of the support member. An arrangement enabling changing the engaging part that holds the movable member only when the movable member is inclined can thus be achieved by means of a very simple, compact construction.

Further preferably, the clasp also has a locking unit that holds the support member and the movable member substantially parallel; and a release operator for releasing the locking unit from the locked state.

With this arrangement the movable member cannot be inclined while the support member and the movable member are held substantially parallel to each other by the locking unit and length adjustment is limited, but the length can be adjusted by working the release operator to disengage the lock. Accidental operation can therefore be reliably prevented without losing convenience because the length will not change when not intended by the user and the length can still be adjusted by means of a simple operation whenever desired.

In another aspect of the invention, the locking unit has a plurality of plate members connected foldably together, and holds the support member and the movable member substantially parallel when the locking unit is folded closed; and one of the bands and the support member are connected by means of the plural intervening plate members of the locking unit.

This arrangement enables enclosing the locking unit in a small space and makes reducing the size of the clasp simple as a result of rendering the locking unit from a plurality of plate members that can be stored folded together, and using these plate members to connect one of the bands to the support member.

Another aspect of the invention is an accessory bracelet having a clasp that connects a pair of bands. The clasp has a support member connected to one of the bands, and a movable member connected to the other of the bands; a plurality of engaging parts that engage the movable member are disposed to the support member along the length of the band; and the movable member can be moved from one engaging part to another engaging part only when the movable member is inclined to the support member.

The interval between the pair of bands connected to each other through the intervening clasp can thus only be changed by inclining the movable member of the clasp to the support member and then moving the movable member from one engaging part to another engaging part. This affords a bracelet type accessory that can be adjusted in length using a simple, easily understood operation. The size of the clasp can also be easily reduced and the decorativeness of the bracelet-style accessory can be improved because the clasp can be rendered by means of a very simple arrangement using a support member and a movable member.

Another aspect of the invention is a timepiece having a pair of bands that are connected to a timepiece case; and a clasp that connects the pair of bands. The clasp has a support member connected to one of the bands, and a movable member connected to the other of the bands; a plurality of engaging parts that engage the movable member are disposed to the support member along the length of the band; and the movable member can be moved from one engaging part to another engaging part only when the movable member is inclined to the support member.

The interval between the pair of bands can thus only be changed by inclining the movable member of the clasp to the support member and then moving the movable member from one engaging part to another engaging part. This affords a timepiece with a band that can be adjusted in length using a simple, easily understood operation. The size of the clasp can also be easily reduced and the decorativeness of the timepiece can be improved because the clasp can be rendered by means of a very simple arrangement using a support member and a movable member.

A clasp according to the present invention for connecting a pair of bands has a support member connected to one of the bands, and a movable member connected to the other of the bands. A plurality of engaging parts that engage the movable member are disposed to the support member arrayed along the length of the band, and the movable member can be moved from one engaging part to another engaging part only when the movable member is inclined to the support member. The interval between the pair of bands connected to each other through the intervening clasp can therefore only be changed by moving the movable member from one engaging part to another engaging part when the movable member of the clasp is inclined to the support member. The length can therefore be adjusted by means of a simple and easy-to-understand operation, and the size of the clasp can be easily reduced because the clasp is very simply constructed.

Other objects and attainments together with a fuller understanding of the invention will become apparent and appreciated by referring to the following description and claims taken in conjunction with the accompanying drawings.

DESCRIPTION OF THE PREFERRED EMBODIMENTS

Preferred embodiments of the present invention are described below with reference to the accompanying figures.

Figure 1:
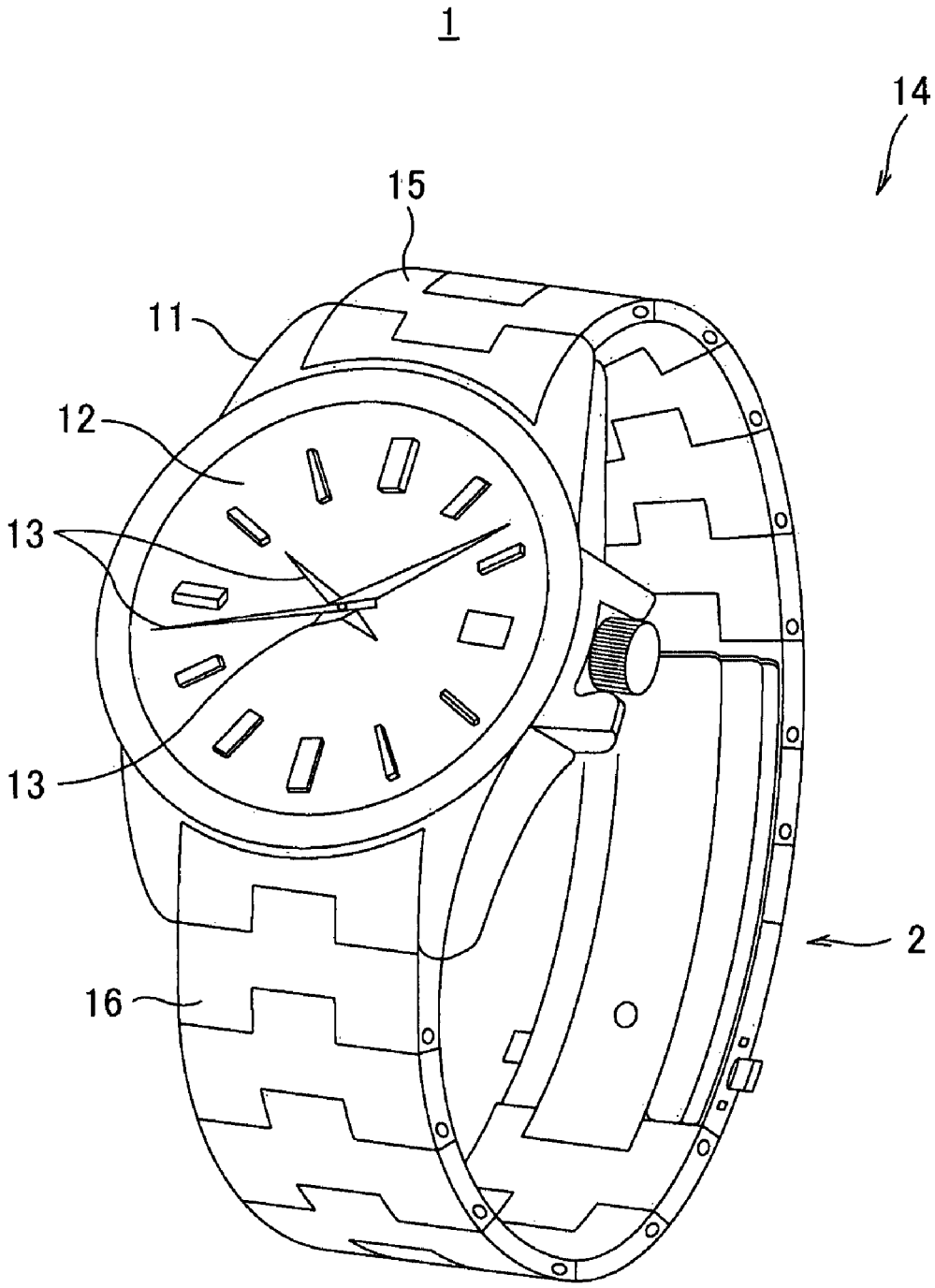
FIG. 1 is an oblique view of a wristwatch according to an embodiment of the invention.

FIG. 1 is an oblique view showing a wristwatch 1 by way of example of a timepiece according to this embodiment of the invention.

This wristwatch 1 has a timepiece case 11 housing a movement not shown, a dial 12, and watch hands 13 in a water-resistant construction. A band 14 is connected to the lugs at the top and bottom ends of the timepiece case 11 as an accessory bracelet for holding the wristwatch 1 at an appropriate position, such as the wrist of the user in this aspect of the invention. The band 14 has a top band 15 and a bottom band 16 as the band portions that are connected to the timepiece case 11 and connected to each other by an intervening clasp 2.

The top band 15 is connected to the timepiece case 11 at the 12:00 o'clock position of the dial 12, and the bottom band 16 is connected to the timepiece case 11 at the 6:00 o'clock position of the dial 12. The top band 15 and the bottom band 16 are each made from a plurality of links made of stainless steel, titanium, or other metal connected to each other so that the links can pivot smoothly with the adjoining links.

Figure 2:
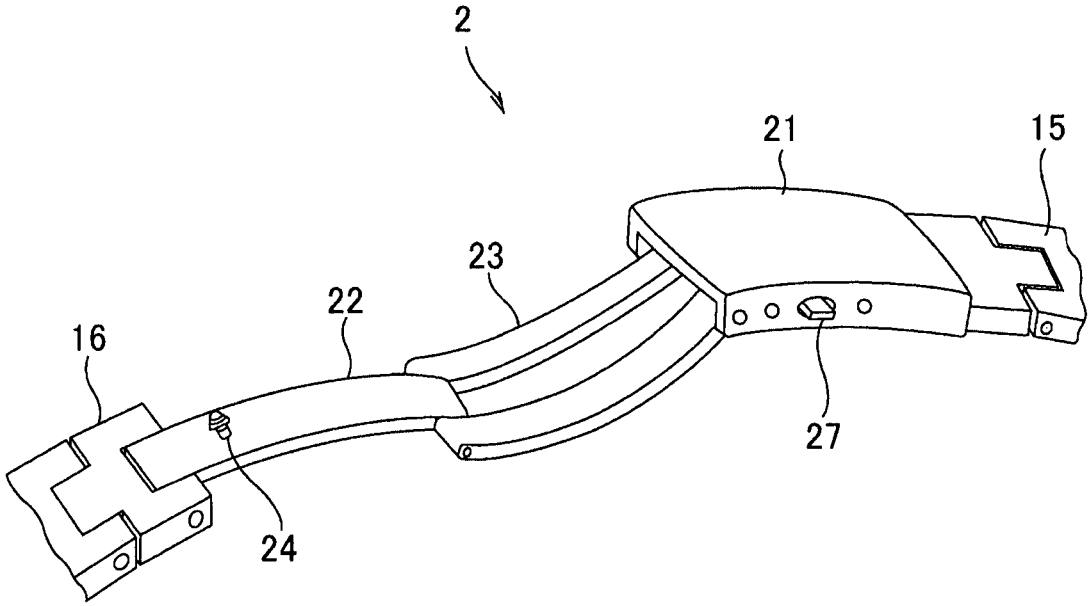
FIG. 2 is an oblique view showing the main components when the clasp is open.

FIG. 2 is an oblique view of the clasp 2 in the open position.

The clasp 2 is a so-called triple deployant folding clasp (or triple deployment folding clasp with side pushers). The clasp 2 includes a cover part 21 that is connected to the end of the top band 15, a bottom arm 22 that is connected to the end of the bottom band 16, and a middle arm 23 that is connected foldably to the bottom arm 22 and the cover part 21. The connection between the cover part 21 and the middle arm 23, and the connection between the bottom arm 22 and the middle arm 23, are each made by means of a pin (not shown in the figure) so that the connections can pivot freely. The top band 15 and the cover part 21, and the bottom band 16 and the bottom arm 22, are similarly connected by means of pins (not shown in the figure) so that they can also pivot freely. This clasp 2 enables the middle arm 23 to fold over the bottom arm 22 below the cover part 21. A lock pin 24 disposed to the bottom arm 22 and a button unit 26 described below render a locking unit for securing the foldable plate members, that is, cover part 21, bottom arm 22, and middle arm 23, closed when folded together.

The lock pin 24 for holding the clasp 2 in the closed folded position is disposed to the bottom arm 22. When the clasp 2 is closed, the lock pin 24 engages and is retained by the button unit 26 (FIG. 3) disposed to the cover part 21, and the clasp 2 is held closed by the retention force of the button unit 26. When a push button 27 disposed as a release operator is pushed, retention of the lock pin 24 by the button unit 26 is released and the clasp 2 opens.

Figure 3:
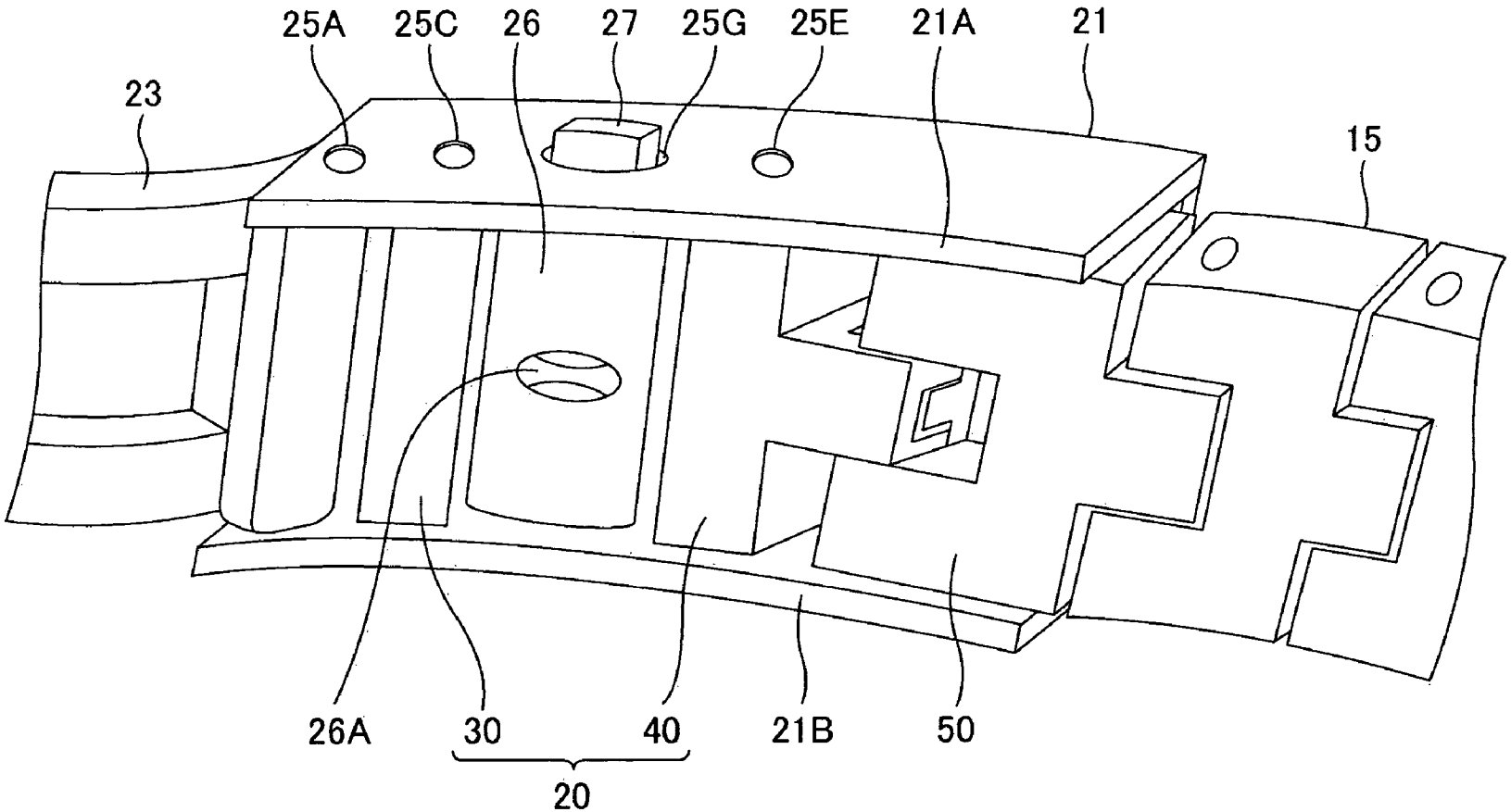
FIG. 3 is an oblique view showing the arrangement of the clasp.
Figure 4:
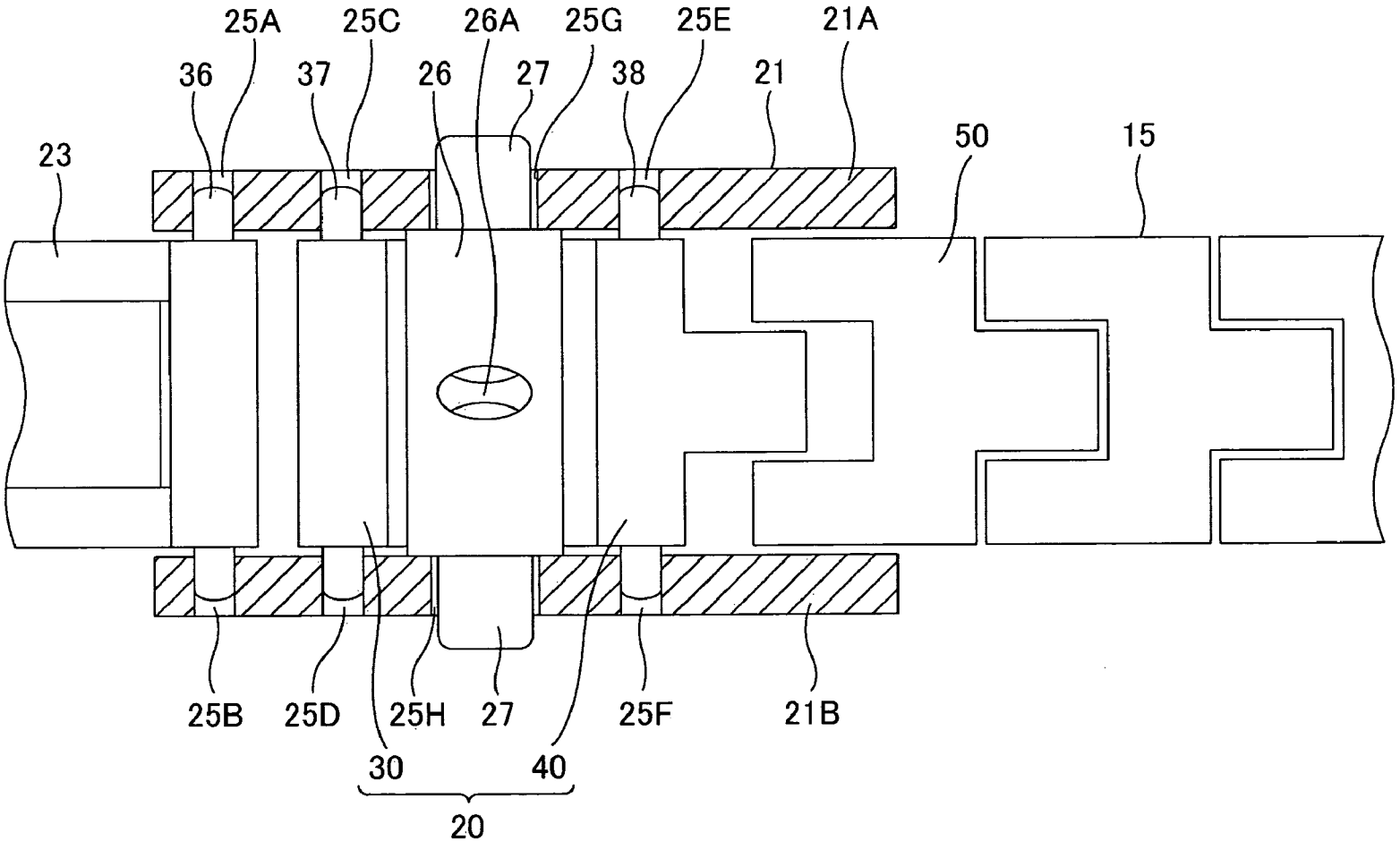
FIG. 4 is a bottom view showing the arrangement of the clasp.
Figure 5:
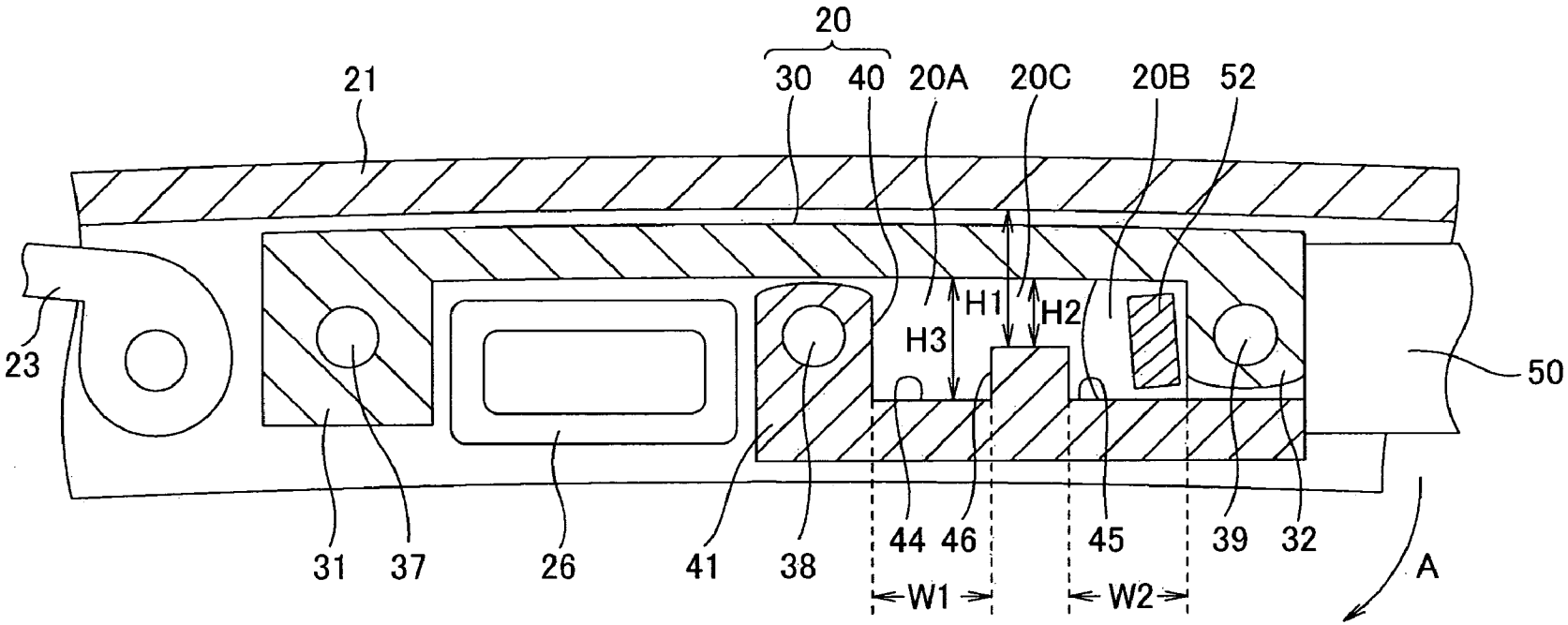
FIG. 5 is a section view showing the arrangement of the clasp.

FIG. 3 to FIG. 5 show the arrangement of the cover part 21 in detail, FIG. 3 being an oblique view from the bottom, FIG. 4 being a bottom view, and FIG. 5 being a section view. Note that "top" and "bottom" as used below indicate the top and the bottom as seen in FIG. 5.

The cover part 21 has side walls 21A and 21B rising from the opposite edges of a substantially rectangular plate with spring pin insertion holes 25A to 25F and button holes 25G and 25H rendered in the side walls 21A, 21B. The end of the middle arm 23, the button unit 26, a support member 20, and a part of the first link 50 of the top band 15 are held between the side walls 21A, 21B.

The middle arm 23 is attached freely pivotably to one end of the cover part 21 by a spring pin 36 disposed between spring pin insertion holes 25A and 25B.

The button unit 26 is disposed in approximately the middle of the cover part 21. The button unit 26 is engaged with the cover part 21 by an intervening pair of push buttons 27 that protrude externally from the button holes 25G, 25H in the side walls 21A, 21B. A lock pin hole 26A is formed in the center of the button unit 26, and a pair of claws connected to the pair of push buttons 27 are exposed in the lock pin hole 26A. This pair of claws are urged together, and squeezing the push buttons 27 together in resistance to this urging force causes the claws the separate.

When the clasp 2 is folded together and closed, the lock pin 24 protruding from the bottom arm 22 is inserted to the lock pin hole 26A. The lock pin 24 inserted to the lock pin hole 26A intercedes between the pair of claws so that the claws engage the lock pin 24 and the clasp 2 is held in the folded closed position.

When the push buttons 27 are then squeezed together, the claws holding the lock pin 24 separate from each other and from the lock pin 24, and the lock pin 24 is thus released. The lock pin 24 can therefore be removed from the lock pin hole 26A and the clasp 2 opened.

The top plate 30 of the support member 20 is attached to the cover part 21 by a spring pin 37 inserted to the spring pin insertion holes 25C and 25D so that the top plate 30 spans both sides of the button unit 26. The bottom plate 40 of the support member 20 is attached to the cover part 21 below the top plate 30 by a spring pin 38 inserted to the spring pin insertion holes 25E, 25F. The ends of the top plate 30 and the bottom plate 40 that are near the top band 15 are connected to each other and to the first link 50 of the top band 15 by a link pin 39.

Figure 6:
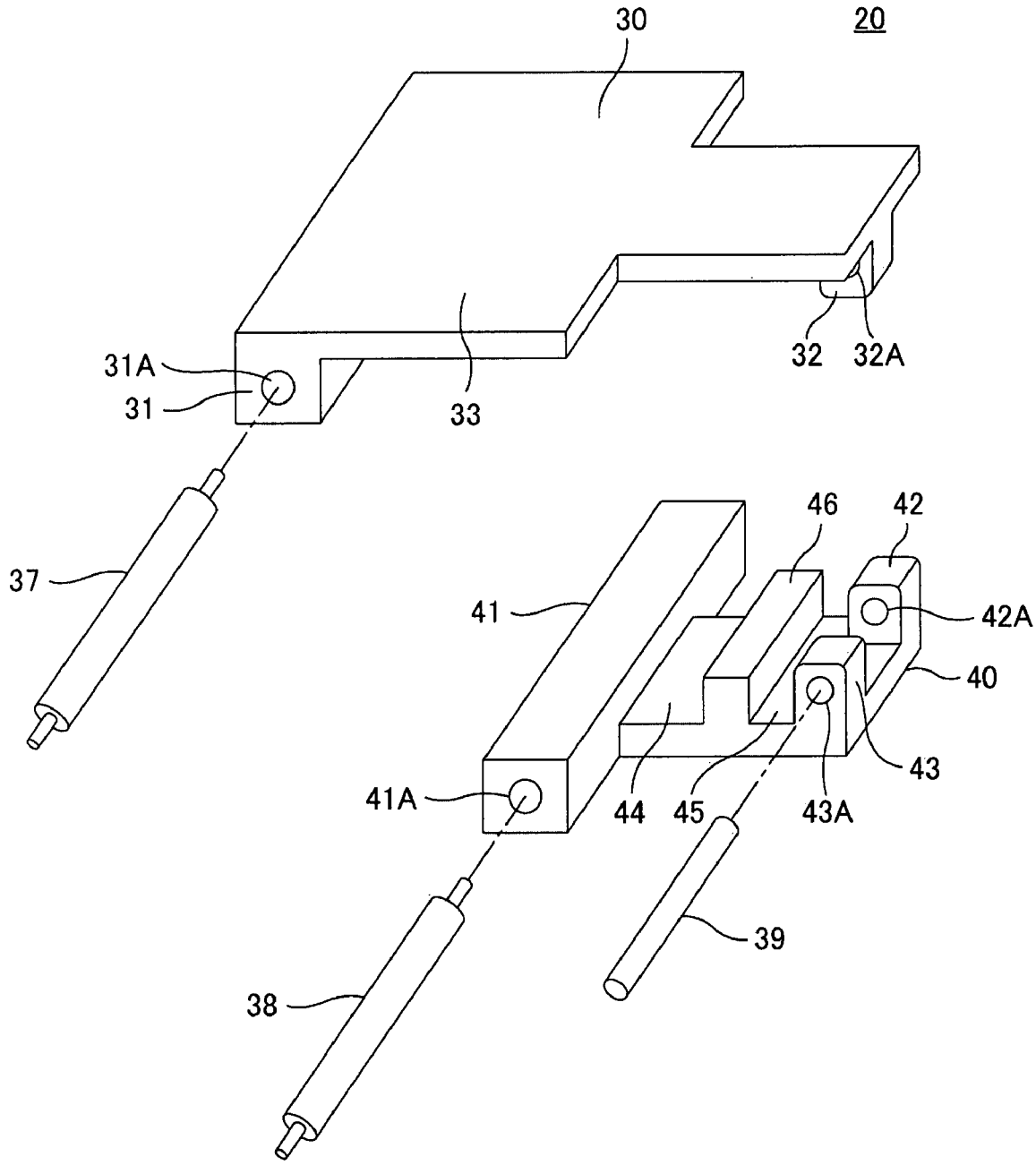
FIG. 6 is an exploded oblique view showing the arrangement of the support members in detail.

FIG. 6 is a partially exploded oblique view showing the arrangement of the support member 20 in detail.

As shown in FIG. 6, the top plate 30 has a substantially flat plate portion 33, a cover connecting part 31 formed at one end of the flat plate part 33, and a bottom plate connecting part 32 formed at the other end of the flat plate part 33. The cover connecting part 31 is a bar-shaped protrusion extending widthwise to the cover part 21. A spring pin insertion hole 31A is formed through the length of the cover connecting part 31, and the spring pin 37 described above is inserted through this spring pin insertion hole 31A. A pin insertion hole 32A is formed widthwise to the cover part 21 through the bottom plate connecting part 32, and the link pin 39 described above passes through this pin insertion hole 32A.

The bottom plate 40 has a cover connecting part 41 disposed on one end of a flat plate member, and top plate connecting parts 42, 43 rendered at the other end of the flat plate. The cover connecting part 41 is a bar-shaped protrusion extending widthwise to the cover part 21. A spring pin insertion hole 41A is formed through the length of the cover connecting part 41, and the spring pin 38 described above passes through this spring pin insertion hole 41A. The top plate connecting parts 42, 43 are protrusions arranged in line widthwise to the cover part 21 so that the bottom plate connecting part 32 of the top plate 30 can be inserted between them. Pin insertion holes 42A, 43A are formed in the top plate connecting parts 42, 43 so that the pin insertion holes 42A, 43A communicate with the pin insertion hole 32A when the top plate 30 and bottom plate 40 are assembled together and the link pin 39 can be inserted through the pin insertion holes 42A, 43A and 32A.

As shown in FIG. 5, the cover connecting part 31 and the cover connecting part 41 are separated by a distance corresponding to the width of the button unit 26. When connected to each other the top plate 30 and the bottom plate 40 together render the support member 20. When the support member 20 is attached to the cover part 21, the support member 20 is supported by the spring pins 37, 38 so that rotation of the support member 20 relative to the cover part 21 is restricted.

Referring again to FIG. 6, a bar 46 and recesses 44 and 45 on opposite sides of the bar 46 are formed on the surface of the bottom plate 40 facing the flat plate part 33 of the top plate 30. The bar 46 is a protrusion extending widthwise to the cover part 21. The recesses 44 and 45 are channels running parallel to the bar 46.

The height of the bar 46 is less than the height of the cover connecting part 41 and the top plate connecting parts 42, 43, and a gap is therefore left between the distal end of the bar 46 and the bottom of the flat plate part 33 when the top plate 30 and the bottom plate 40 are connected together. This gap is referred to below as a passage 20C. The space formed between the recess 44 of the bottom plate 40 and the bottom of the flat plate part 33 forms a receiver unit 20A, and the space formed between the recess 45 of the bottom plate 40 and the bottom of the flat plate part 33 forms a receiver unit 20B.

As shown in FIG. 5, the receiver units 20A and 20B are disposed parallel to each other substantially perpendicularly to the length of the cover part 21, and therefore to the length of the band 14, and the receiver units 20A and 20B communicate with each other through the passage 20C intervening therebetween. The crossbar 52 of the first link 50 is held in receiver unit 20A or 20B.

Figure 7:
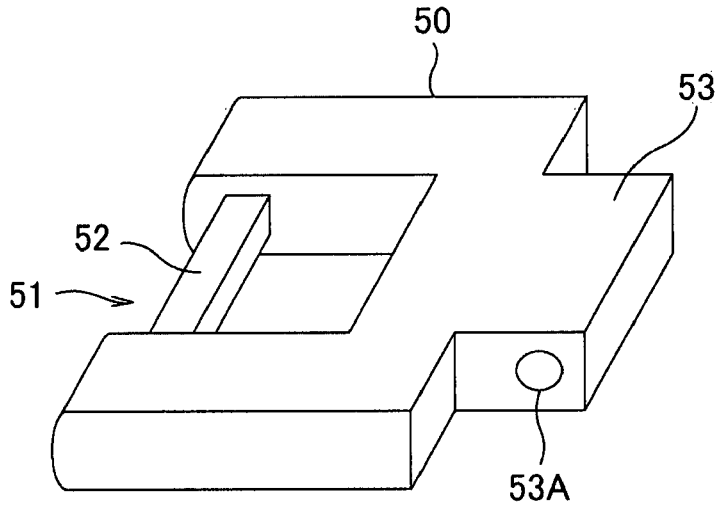
FIG. 7 is an external oblique view showing the arrangement of a first link.
Figure 8:
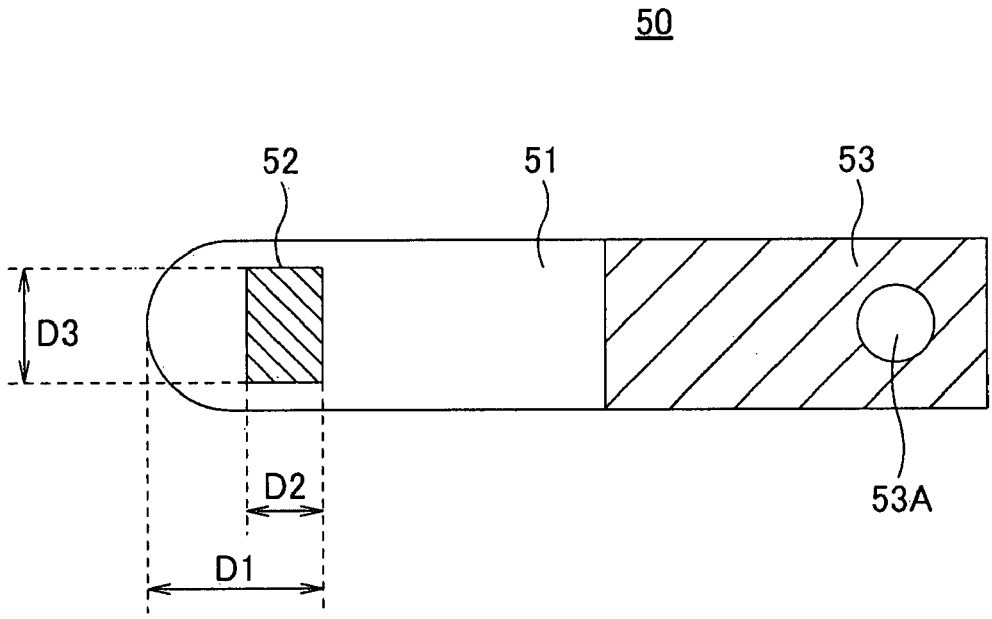
FIG. 8 is a section view showing the arrangement of a first link.

FIG. 7 is an oblique view and FIG. 8 is a section view showing the arrangement of the first link 50.

As shown in FIG. 7 and FIG. 8, the first link 50 is a movable member that has a link connecting part 53 at the base end side, that is, the end at the top band 15, and is connected to the next link in the top band 15 by means of a pin (not shown in the figure) that passes through a pin insertion hole 53A passing through the link connecting part 53.

A notched part 51 extending in line with the length of the band 14 is formed at the distal end of the first link 50, and the crossbar 52 is formed as a catch across the notched part 51.

The crossbar 52 is rectangular in section with the long side in line with the thickness of the first link 50 and sized to fit inside the receiver units 20A and 20B of the support member 20 as shown in FIG. 5. The crossbar 52 can be moved by the operation described below between the receiver unit 20A and the receiver unit 20B.

Figure 9:
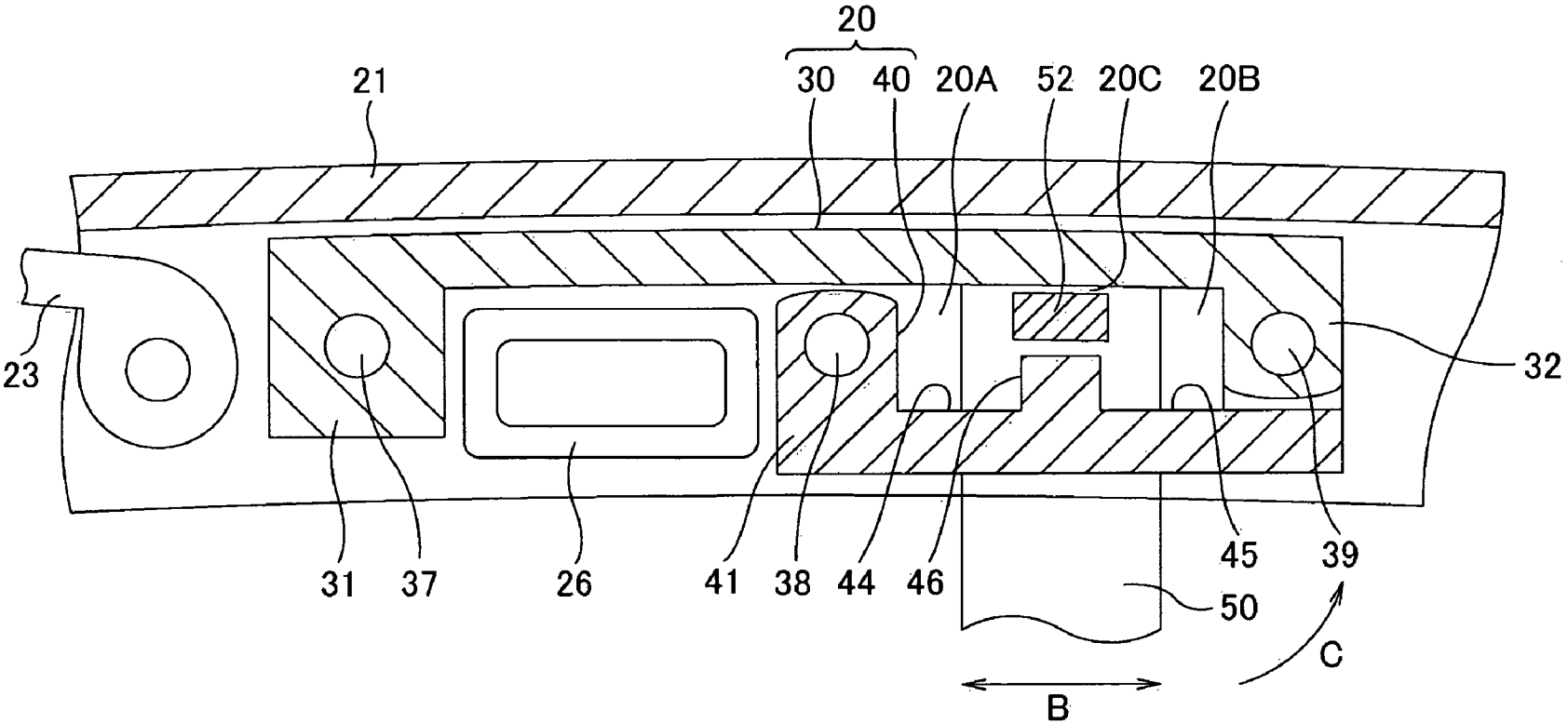
FIG. 9 describes adjusting the length of the band portion.
Figure 10:
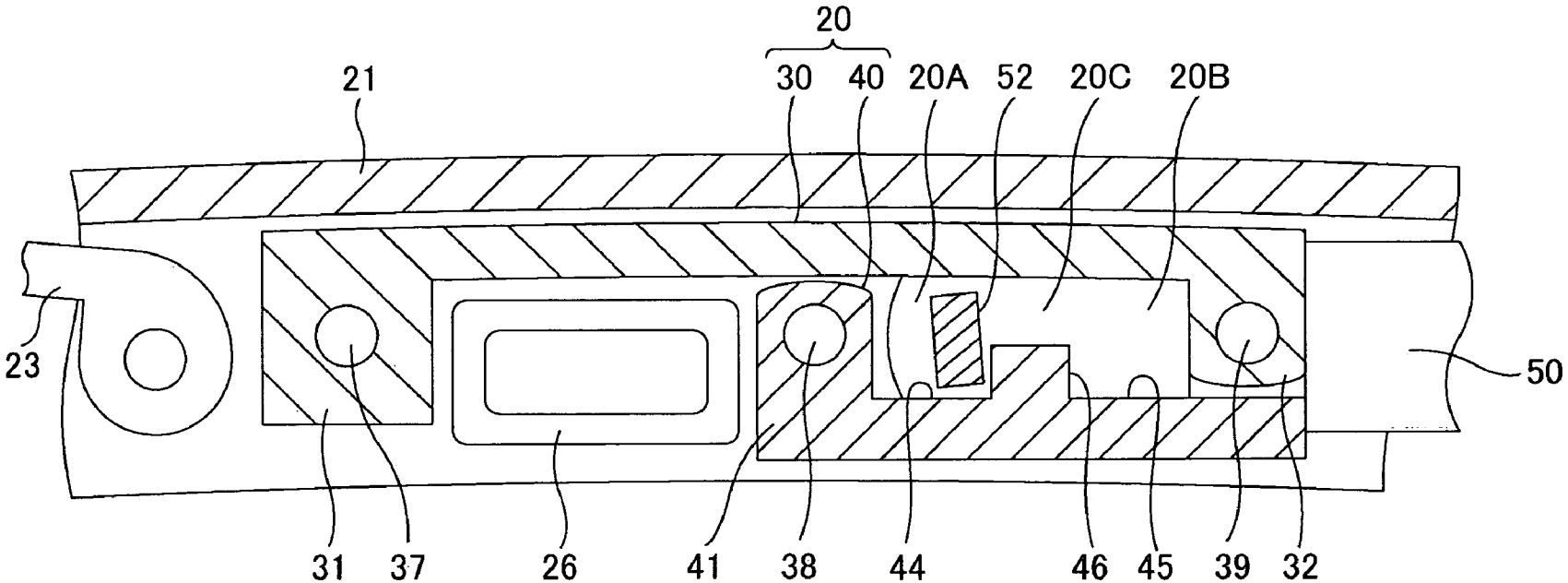
FIG. 10 describes adjusting the length of the band portion.

FIG. 9 and FIG. 10 are section views showing the arrangement of the cover part 21. The procedure for adjusting the length of the band 14 is described next with reference to FIG. 9, FIG. 10, and FIG. 5.

As shown in FIG. 5, when the crossbar 52 of the first link 50 is held in the receiver unit 20B, the crossbar 52 is between the bottom plate connecting part 32 and the bar 46, and movement of the crossbar 52 is thus limited.

The first link 50 is then rotated substantially on the crossbar 52 in the direction of arrow A in FIG. 5 until the first link 50 is substantially perpendicular to the support member 20 as shown in FIG. 9. The size of the crossbar 52 in line with the thickness of the band 14 at this time is smaller than the passage 20C. More specifically, the height of the crossbar 52 in this position is less than the height of the passage 20C, and the crossbar 52 can therefore pass through the passage 20C and the first link 50 can move parallel to arrow B in FIG. 9.

After moving the first link 50 substantially parallel to the length of the band 14, the first link 50 is rotated in the direction of arrow C in FIG. 9 around the crossbar 52 until the first link 50 is again parallel to the cover part 21 as shown in FIG. 10. The crossbar 52 now held in the receiver unit 20A is disposed between and movement of the crossbar 52 is limited by the cover connecting part 41 and the bar 46.

As described above, the receiver unit 20A and the receiver unit 20B are disposed parallel to each other along the length of the band 14, and the bar 46 rising into the receiver unit 20A and the bottom plate connecting part 32 forming one side of the receiver unit 20B work as engaging parts limiting the movement of the crossbar 52. The distance between the middle arm 23 and the first link 50 can therefore be changed by moving the crossbar 52 between the receiver unit 20A and the receiver unit 20B. More particularly, the length of the band 14 can be adjusted.

This length adjustment is only possible when the first link 50 is rotated to a position substantially perpendicular to the support member 20. When the clasp 2 is folded closed, the middle arm 23 and the bottom arm 22 are folded together below the 21 and the first link 50 cannot be rotated. The push buttons 27 must therefore be operated to open the clasp 2 in order to adjust the length of the band 14.

The length of the band 14 will therefore not change when the wristwatch 1 is being worn, but the length can be easily adjusted when the user wants to intentionally adjust the band 14. The arrangement of the invention thus both affords easy operation while eliminating accidental operation.

In order to achieve the arrangement described above, the sizes of the receiver units 20A and 20B, the passage 20C, and the crossbar 52 are preferably in a specific relationship. To simplify the description with reference to FIG. 5, the height from the top of the bar 46 to the bottom of the cover part 21 is H1, the height from the top of the bar 46 to the bottom of the flat plate part 33 is H2, the height from the bottom of the recesses 44 and 45 to the bottom of the flat plate part 33 is H3, and the width of the recesses 44 and 45 is W1 and W2, respectively. In addition, as shown in FIG. 8, the distance from the distal end of the first link 50 to the base end side of the crossbar 52 is D1, the depth of the crossbar 52 (that is, the length of the short side in section view) is D2, and the height of the crossbar 52 (that is, the length of the long side in section view) is D3.

In order to rotate the first link 50 until it is substantially perpendicular to the support member 20 as shown in FIG. 9, there must be enough space inside the receiver units 20A and 20B to the bottom of the cover part 21 for the distal end of the first link 50 to rotate. Preferably, therefore, D1<H1. Further preferably, D3<H3 so that the crossbar 52 can rotate inside the receiver units 20A and 20B.

Further preferably, D2<H1 in order for the crossbar 52 to pass through the passage 20C as shown in FIG. 9. Yet further preferably, H2<D3 so that movement of the crossbar 52 is limited when positioned as shown in FIG. 5 and FIG. 10.

In brief, the conditions stated in equations (1) to (3) below are preferably met.

$$D1<H1 \quad (1)$$

$$D2<H2 \quad (2)$$

$$H2<D3<H3 \quad (3)$$

In order to easily rotate the crossbar 52 inside the receiver units 20A and 20B, the width W1 of the receiver unit 20A and the width W2 of the receiver unit 20B are preferably sufficiently great, and further preferably meet the conditions state in equations (4) and (5).

$$D3<W1 \quad (4)$$

$$D3<W2 \quad (5)$$

As described above, this aspect of the invention disposes a support member 20 inside the cover part 21 of the clasp 2 so that rotation of the support member 20 is restricted, engages the crossbar 52 of the first link 50 in the top band 15 in the receiver units 20A and 20B rendered beside each other along the length of the band 14, and permits the crossbar 52 to move between the receiver units 20A and 20B only when the first link 50 is rotated a specific angle (substantially perpendicular in this aspect of the invention) to the support member 20. The length of the band 14 can therefore be adjusted by the simple operation of rotating and then moving the first link 50 parallel to the band 14 length.

Furthermore, the length of the band 14 will not change when the wristwatch 1 is being worn because the clasp 2 must be opened in order to rotate the first link 50. The length of the band 14 will therefore not change unless intended by the user, and accidentally changing the length is reliably prevented.

The clasp 2 can also be easily opened by squeezing the push buttons 27 and the user can therefore easily adjust the length of the band 14 as desired. The operation for adjusting the length of the band 14 is also clearly different from the operation opening the clasp 2, and is therefore quite easily understood by the user.

The simple arrangement including the support member 20 and the first link 50 affords a simple, easily understood length adjustment, and easily enables reducing the size of the clasp 2. Furthermore, because rotating the first link 50 is prevented by folding the clasp 2 closed, the length of the band 14 will not change unless intended by the user. Accidental operation can therefore be prevented without increasing the size of the clasp mechanism. The decorativeness of the band 14 can therefore be improved by an arrangement enabling easily reducing the size of the clasp 2.

The top plate 30 and the bottom plate 40 are separate members that are connected to render the support member 20 in the aspect of the invention described above, but the invention is no so limited and a single member can be used instead.

Figure 11:
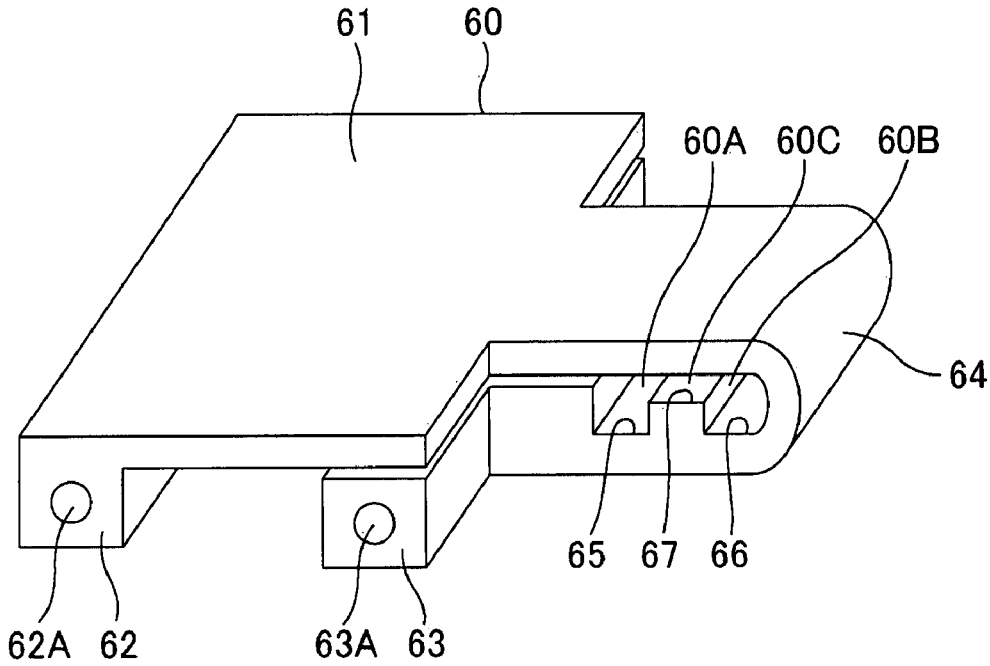
FIG. 11 is an oblique view showing a variation of the support member.

As shown in FIG. 11, a single-piece connecting member 60 can be used instead of the support member 20. This connecting member 60 has a first cover connecting part 62 disposed to one end of a substantially flat base plate 61, and a second cover connecting part 63 disposed to the other end of the base plate 61. The first cover connecting part 62 has a spring pin insertion hole 62A through which the spring pin 37 passes, and the second cover connecting part 63 has a spring pin insertion hole 63A through which the spring pin 38 passes. The second cover connecting part 63 is folded back around a curved return 64 so that the first cover connecting part 62 and the second cover connecting part 63 do not overlap. Similarly to the bottom plate 40 described above, the connecting member 60 has a protruding bar 67 extending across the width of the cover part 21, recesses 65 and 66 on opposite sides of the bar 67. These recesses 65 and 66 and the bar 67 form receiver units 60A and 60B for holding the crossbar 52, and a passage 60C connecting the receiver units 60A and 60B to each other. Disposing this connecting member 60 to the cover part 21 instead of the support member 20 renders an arrangement in which the crossbar 52 can pass through the passage 60C only when the first link 50 is rotated to a position substantially perpendicular to the connecting member 60, thus affording the same effect as the embodiment described above. In this aspect of the invention the curved return 64 and the bar 67 function as engaging parts limiting movement of the crossbar 52.

The crossbar 52 of the first link 50 is described above as a bar that is rectangular in section, but the invention is not so limited. More particularly, the round crossbar 72 could be a round rod as shown in FIG. 12.

Figure 12:
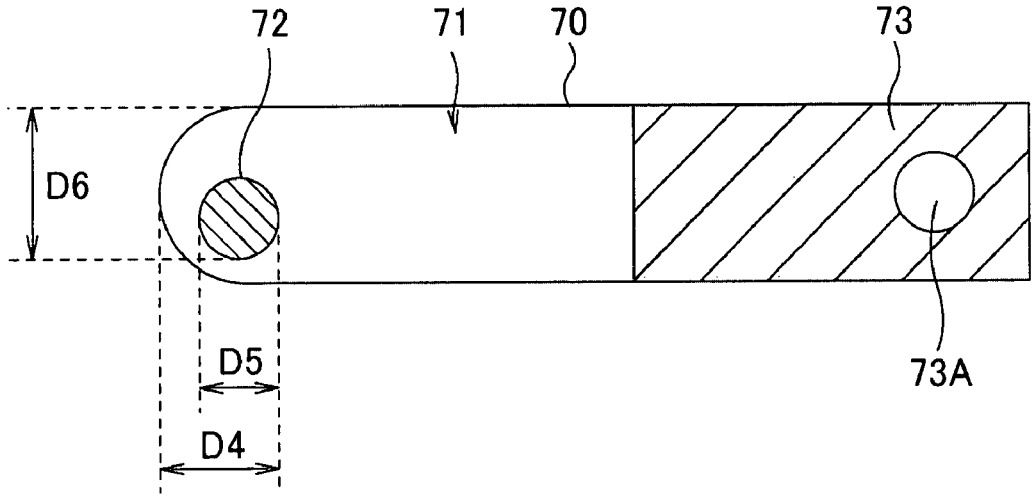
FIG. 12 is a section view showing a variation of the first link.

The first link 70 shown in FIG. 12 functions as a moving member connected to the end of the top band 15 instead of the first link 50. A pin insertion hole 73A for holding a pin (not shown in the figure) is formed in the first link 70 through the link connecting part 73 on the top band 15 side end. A notched part 71 extending in line with the length of the band 14 is formed at the distal end of the first link 70, and the round crossbar 72 is formed as a catch across the notched part 71.

The round crossbar 72 is disposed eccentrically to the thickness of the first link 70. The round crossbar 72 is disposed eccentrically so that when the first link 70 is used instead of the first link 50 described above, the first link 70 can only be moved in the parallel direction when the first link 70 is turned a specific angle.

Figure 13:
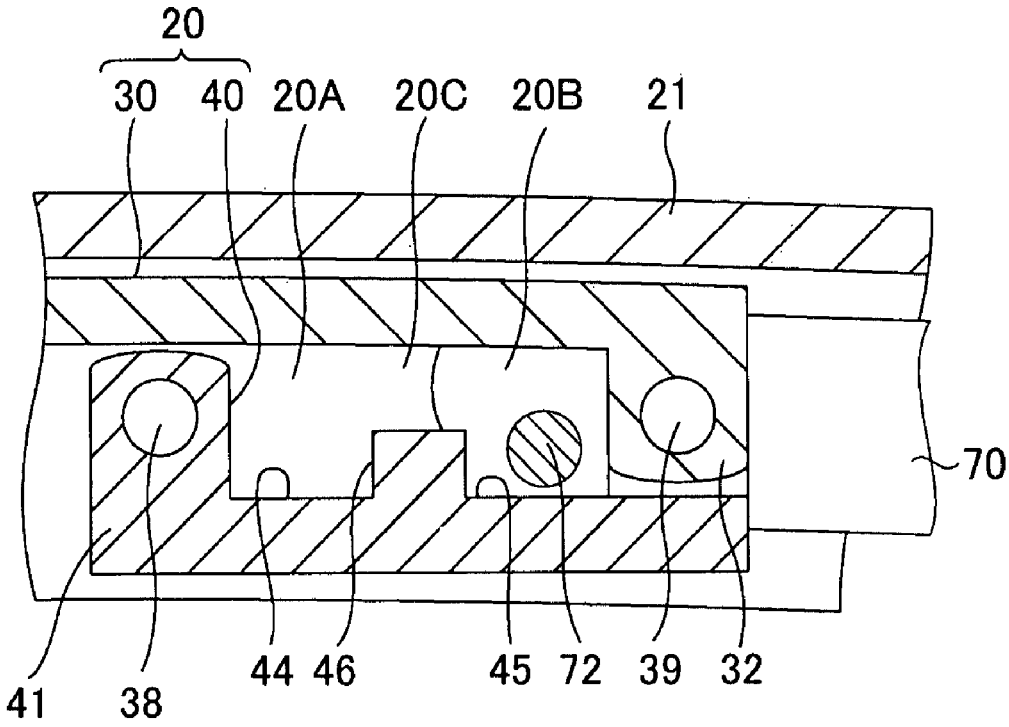
FIG. 13 is a section view showing a variation of the clasp.

More specifically, as shown in FIG. 13, when the first link 70 is connected to the support member 20 and the round crossbar 72 is held in the receiver unit 20B, the round crossbar 72 is disposed offset toward the bottom as seen in the figure. Movement of the round crossbar 72 is therefore limited by the bar 46 and the bottom plate connecting part 32. When the first link 70 is then rotated to substantially perpendicularly to the support member 20, the round crossbar 72 can move in the thickness direction of the clasp 2 toward the passage 20C side, thus allowing the round crossbar 72 to pass through the passage 20C and move between the receiver unit 20A and the receiver unit 20B.

In order for the first link 70 to be pivotable substantially perpendicularly to the support member 20 and the round crossbar 72 to be able to pass through the passage 20C when the first link 70 is so rotated, the distance D4 from the distal end of the first link 70 to the back edge of the round crossbar 72 as shown in FIG. 12, the diameter D5 of the round crossbar 72, and the distance D6 from the top of the first link 70 to the bottom edge of the round crossbar 72 preferably meet the conditions shown in equations (6) to (8) below where H1, H2, and H3 are as defined above with reference to FIG. 5.

$$D4<H1 \quad (6)$$

$$D5<H2 \quad (7)$$

$$D6>H1 \quad (8)$$

The same effects described above can thus be achieved using the first link 70 with a round crossbar 72 instead of the first link 50 with a crossbar 52 having a rectangular section.

The invention has also been described using an arrangement in which a passage 20C enables movement between the two receiver units 20A and 20B by rendering a single bar 46 in the support member 20, but the invention is not so limited. For example, a plurality of such bars with recessed parts on both sides of the bars can be formed to render a plurality of receiver units and alternating passages therebetween in line with the length of the band 14. This enables adjusting the length of the band 14 in more stages.

The top band 15 and the bottom band 16 in the foregoing embodiments are not limited to bands formed by connecting a plurality of metal links together. Leather bands or rubber bands made of urethane rubber for example, can be used instead, and other aspects of the detailed arrangement can also be changed appropriately.

The invention is also not limited to a triple deployant clasp such as described above, and can be widely applied to other types of clasps including double folding clasps and butterfly clasps.

The invention has also been described using the band of a wristwatch by way of example, but can be widely applied to other types of band or bracelet type accessories, including jewelry bracelets, necklaces, clothing belts, and belts for handbags and other accessories.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

The entire disclosure of Japanese Patent Application No. 2006-146158, filed May 26, 2006 is expressly incorporated by reference herein.

What is claimed is:

1. A clasp for connecting a pair of bands, the clasp comprising:

a support member connected to one of the bands;

a movable member connected to the other of the bands;

a plurality of engaging parts being disposed to the support member along the length of the band, the plurality of engaging parts which engage the movable member;

a locking unit that holds the support member and the movable member substantially parallel; and a release operator for releasing the locking unit from a locked state, the movable member being moved from one engaging part to another engaging part only when the movable member is inclined to the support member, a catch part being formed on the distal end part of the movable member, the catch part being shaped so that the size of the catch part in line with the length of the band decreases, at least one of the engaging parts being rendered as a protrusion into the space where the catch part is held, and forming on the distal end side thereof a passage enabling the catch part to pass only when in the position where the size is decreased.

2. An accessory bracelet comprising:

the clasp that is described in claim 1.

3. A timepiece comprising:

a pair of bands that are connected to a timepiece case; and the clasp that is described in claim 1, and that connects the pair of bands.

4. A clasp for connecting a pair of bands, the clasp comprising:

a support member connected to one of the bands;

a movable member connected to the other of the bands;

a plurality of engaging parts being disposed to the support member along the length of the band, the plurality of engaging parts which engage the movable member;

a locking unit that holds the support member and the movable member substantially parallel; and a release operator for releasing the locking unit from a locked state, the movable member being moved from one engaging part to another engaging part only when the movable member is inclined to the support member, a catch part being formed on the distal end part of the movable member for engaging an engaging part of the support member, at least one of the engaging parts being rendered as a protrusion into the space where the catch part is held, and forming on the distal end side thereof a passage of a size enabling the catch part to pass, the catch part moving to the passage side and passing through the passage only when the movable member is inclined to the support member.

5. An accessory bracelet comprising:

the clasp that is described in claim 4.

6. A timepiece comprising:

a pair of bands that are connected to a timepiece case; and the clasp that is described in claim 4, and that connects the pair of bands.

7. A clasp for connecting a pair of bands, the clasp comprising:

a support member connected to one of the bands;

a movable member connected to the other of the bands;

a plurality of engaging parts being disposed to the support member along the length of the band, the plurality of engaging parts which engage the movable member;

the movable member being moved from one engaging part to another engaging part only when the movable member is inclined to the support member, the locking unit including a plurality of plate members connected foldably closed together, and holding the support member and the movable member substantially parallel when the locking unit is folded closed together, one of the bands and the support member being connected by means of the plural intervening plate members of the locking unit.

8. An accessory bracelet comprising:

the clasp that is described in claim 7.

9. A timepiece comprising:

a pair of bands that are connected to a timepiece case; and the clasp that is described in claim 7, and that connects the pair of bands.

* * * * *